US005302888A

United States Patent [19]

Hellums et al.

[11] Patent Number: 5,302,888

[45] Date of Patent: Apr. 12, 1994

[54] CMOS INTEGRATED MID-SUPPLY VOLTAGE GENERATOR

[75] Inventors: James R. Hellums, Plano; Henry T. Yung, Richardson, both of Tex.

[73] Assignee: Texas Instruments Incorporated, Dallas, Tex.

[21] Appl. No.: 861,759

[22] Filed: Apr. 1, 1992

[51] Int. Cl.[5] ..... G05F 3/26

[52] U.S. Cl. ..... 323/280; 323/281; 323/314

[58] Field of Search ..... 323/280, 281, 313, 314; 307/296.8; G05F 3/24, 3/26

[56] References Cited

U.S. PATENT DOCUMENTS

| | | | |
|---|---|---|---|
| 4,812,735 | 3/1989 | Sawada et al. | 323/313 |
| 4,906,914 | 3/1990 | Ohsawa | 323/314 |
| 4,954,769 | 9/1990 | Kalthoff | 323/313 |
| 5,027,053 | 6/1991 | Ohri et al. | 323/314 |
| 5,030,848 | 7/1991 | Wyatt | 307/296.8 |
| 5,146,152 | 9/1992 | Jin et al. | 323/280 |

FOREIGN PATENT DOCUMENTS

| | | | |
|---|---|---|---|
| 2939515 | 5/1981 | Fed. Rep. of Germany | 323/313 |

*Primary Examiner*—William H. Beha, Jr.

*Attorney, Agent, or Firm*—Stanton C. Braden; Richard L. Donaldson

[57] ABSTRACT

A CMOS on chip mid-rail voltage generation circuit is provided for an analog ground reference. A voltage divider establishes a current path between the high and low rail, and supplies a mid-level voltage to one input of a differential amplifier. A pair of series connected field effect transistors are also connected between the high and low voltage rails, with their common connection providing the input to the other input of the differential amplifier. A pair of open loop output transistors are also coupled in series between the high and low voltage rails, and each has their gate coupled to one of the series connected pair, and is also matched to that pair.

17 Claims, 1 Drawing Sheet

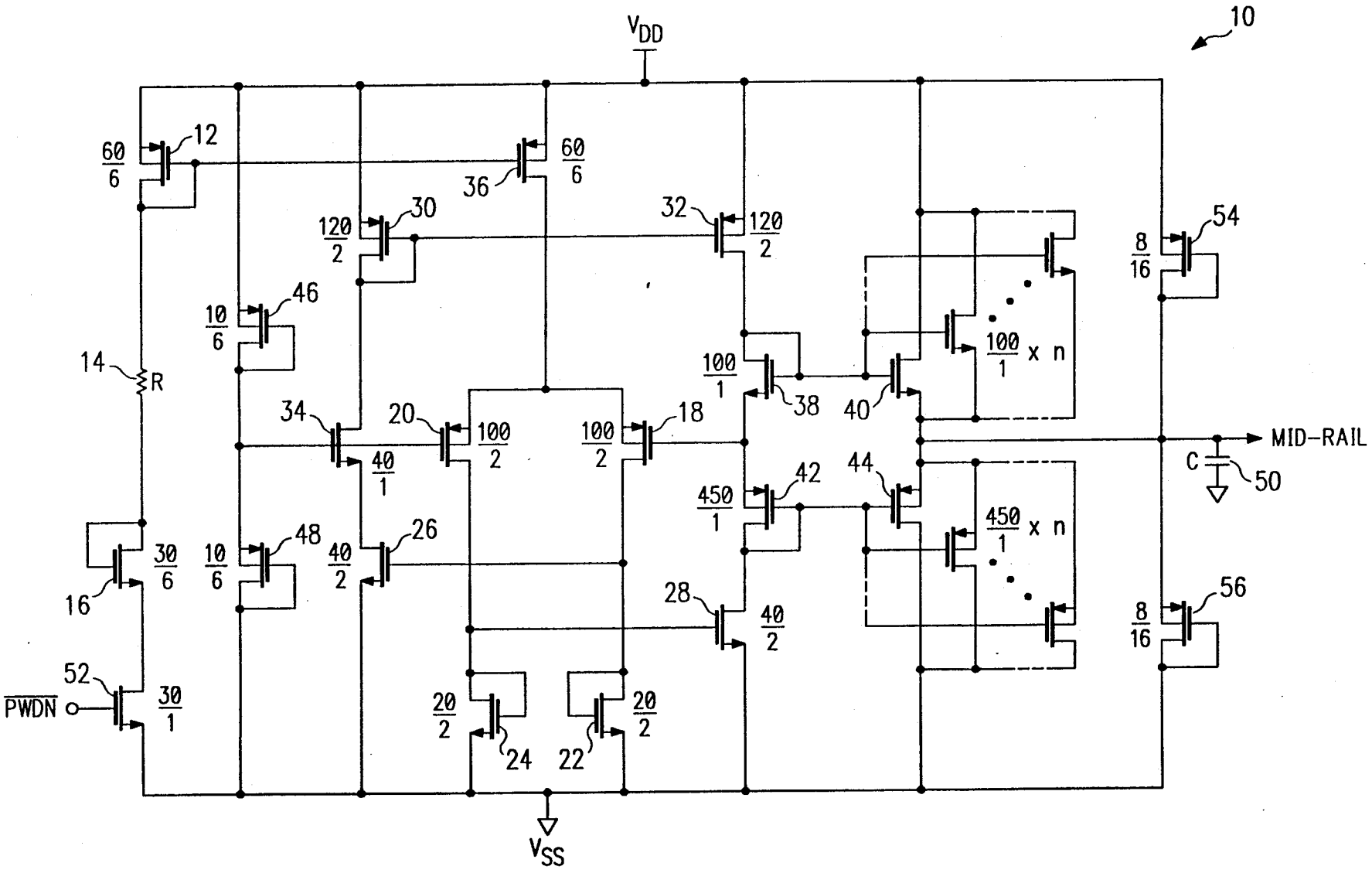
10
MID-RAIL
C
50
54
56
8/16
8/16
100/1 x n
450/1 x n
40
44
38
42
120/2
40/2
100/1
450/1
32
28
18
100/2
20/2
22
60/6
36
24
100/2
20/2
30
20
26
120/2
40/1
40/2
34
46
48
10/6
10/6
12
60/6
R
14
30/6
16
30/1
52
PWDN
VDD
VSS

CMOS INTEGRATED MID-SUPPLY VOLTAGE GENERATOR

TECHNICAL FIELD OF THE INVENTION

The present invention relates in general to electronic circuits and in particular to voltage generation circuits and methods.

BACKGROUND OF THE INVENTION

Single-rail integrated circuit systems which include analog devices and which also employ only a single voltage power supply and ground return, typically require the generation of an on-chip mid-supply voltage for an analog ground (AGND) reference. One currently available method of generating the mid-rail voltage while maintaining a low AC impedance is to use large value polysilicon resistors as a voltage divider to set the half-supply voltage, and then using an operational amplifier configured as a voltage follower (i.e., having unity gain feedback) to buffer the AGND supply. With the unity gain buffer approach, however, significant trade-offs must be made between circuit stability, bandwidth and slew rate. At d.c., the closed-loop output impedance of an operational amplifier is equal to its d.c. open-loop output impedance ($\sim 1K\Omega$ for a CMOS device) divided by the loop gain, which is typically on the order of $1\Omega$. At the unity gain frequency and beyond, however, the operational amplifier output impedance approximates the a.c. open-loop impedance which typically can range between $1-10\Omega$ for a CMOS device. The result is that the mid-rail voltage supply generator will be slow to respond to frequencies beyond its unity gain bandwidth, such that high speed clock coupling and high frequency noise become a problem.

Since CMOS circuits are primarily capacitive in nature, the AGND (analog ground) output node of the operational amplifier will have a large amount of capacitance coupled to it, and therefore, for unity gain stability, the operational amplifier must be internally compensated which decreases its slewing capability. To increase slewing in turn requires more current, and thus more power dissipation. Finally, because the AGND voltage generator must drive a capacitive load, then for the bandwidth to remain relatively constant, the ratio of the transconductance $g_m$ of the operational amplifier input stage to the value of the compensation capacitor $C_c$ must remain constant, even as larger compensation capacitors are required. Therefore, the transconductance $g_m$ must also increase as larger values of the compensation capacitor are required. Each of these design modifications causes an increase in the physical size of the mid-supply generator and in the required supply current.

Thus, the need has arisen for an improved mid-rail voltage supply generator having good stability, bandwidth and slew rate, while at the same time being relatively small in physical size and requiring minimum supply current.

SUMMARY OF THE INVENTION

According to the invention, a voltage generation circuit is provided including a differential amplifier having positive and negative single inputs and first and second outputs A voltage divider circuit is provided included first and second transistors having source/drain paths coupled in series to establish a current path between a high voltage rail and low voltage rail, the first and second transistors matched to provide a mid-supply voltage at a node along the current path, the node coupled to the positive input of the differential amplifier. Third and fourth transistors are provided having source/drain paths coupled in series between the first and second outputs of the differential amplifier, of the sources of the third and fourth transistors coupled to the negative input of the differential amplifier. The gate of the third transistor is coupled to the first output of the differential amplifier and the gate of the fourth transistor is coupled to the second output of the amplifier. A pair of open loop output transistors having source/drain paths coupled in series between the voltage rails is provided The sources of the output transistors are coupled together to provide a low impedance output for the voltage generator circuit. A first one of the output transistors includes a gate coupled to the first output of the differential amplifier, and is matched to the third transistor. A second one of the output transistors has a gate coupled to the second output and is matched to the fourth transistor.

The present invention provides an improved mid-rail voltage supply generator having good stability, band width, slew rate and low output impedance while at the same time being relatively small in physical size and requiring minimum supply of current.

BRIEF DESCRIPTION OF THE DRAWINGS

For a more complete understanding of the illustrated embodiments of the present invention, and the advantages thereof, reference is now made to the following descriptions, taken in conjunction with the accompanying drawings in which:

FIG. 1 is a electrical schematic diagram of a voltage generation circuit according to the present invention.

DETAILED DESCRIPTION OF THE INVENTION

Referring to FIG. 1, a mid-rail (analog ground) voltage generation circuit is shown generally at 10. In the preferred embodiment, generator 10 is fabricated as part of an integrated circuit including analog devices requiring a ground reference. In the illustrated embodiment, circuit 10 operates between a high rail ($V_{DD}$) and a low rail ($V_{SS}$), which typically are +5 volts and ground. It is important to recognize, however, that circuit 10 can also be used between differing voltage rails such +10 volts and 0 volts, the operation being substantially the same. P-channel field effect transistor 12, a resistor 14 and n-channel field effect transistor 16 are current source for a differential amplifier made up of field effect transistors 18, 20, 22, 24, 26, 28, 30, 32, 34 and 36. Resistor 14 may be a high sheet resistance polysilicon layer or formed from a diffused region on the chip. Transistor 36 is the tail current device which mirrors the current flowing in transistor 12 into the differential pair formed by p-channel transistors 18 and 20. N-channel transistors 22 and 24 provide the load devices for the differential pair of transistors 18 and 20. N-channel transistors 26 and 28 are common source transistor amplifiers used to increase the voltage gain at the output of the differential pair formed by transistors 18 and 20. P-channel transistors 30 and 32 form a unity gain current mirror used to translate the voltage gain of transistor 26 to the gates of transistors 38 and 40. Transistor 28 directly drives the gates of p-channel transistors 42 and 44. N-channel transistor 34 is a cascode device used to increase the output resistance of transistor 26, thereby eliminating channel-length modulation effects.

The positive input to the differential amplifier (the gate of transistor 20) is set to the mid-supply voltage by equally sized (matched) diode connected p-channel transistors 46 and 48. Since for the fabrication of a given integrated circuit factors, such as gate oxide thickness and gate capacitance per area are essentially the same for all transistors on the chip, the problem of matching primarily concerns itself with matching width/length ratios of the transistor channels. The negative input of the differential amplifier (the gate of transistor 18) is the common connection to the sources of transistors 38 and 42, both of which are also diode connected. The gates and drains of transistors 38 and 42 are driven by the outputs (the drains of transistors 28 and 32) of the differential amplifier, the negative feedback of the circuit connection to the gate of transistor 18 forcing the common sources of transistors 38 and 42 to the mid-supply voltage. The output is then forced to the mid-supply voltage by the matching of transistor 38 to transistor 40, and transistor 42 to transistor 44. The common sources of transistors 40 and 44 provide a low impedance output for circuitry 10. In the illustrated embodiment, transistors 38 and 42 are matched at a 1:10 ratio to transistors 40 and 44. In this embodiment transistor 40 mirrors the current flow through transistor 38 with a current gain of ten and transistor 44 mirrors the current flow through transistor 42 with a current gain of ten. In alternate embodiments, the current gains may be adjusted by changing the matching between the transistors 38 and 42 and transistors 40 and 44. To further improve matching, transistor 40 and 44 may be fabricated as a group of parallel transistors, each substantially equal in size (i.e., channel width to length ratios substantially equal) to transistors 38 and 42. For example, in the illustrated embodiment, transistor 38 has a width/length ratio of 100/1 and therefore preferably, transistor 40 is fabricated as ten 100/1 transistors to arrive at the equivalent of a 1000/1 transistor.

The only variations (errors) in the mid-supply voltage available at the output come from any mismatch in the impedance of transistors 40 and 42 from differences in transconductance and output conductance. The offset at the circuit output compared to a voltage exactly one-half of the supply voltage is not a substantial problem if the offset remains on the order of tens of millivolts, since the output voltage will be used for the analog ground for any circuits referenced to it. If, however, the offset at the output of the circuit increases to the order of hundreds of millivolts or more, the dynamic range for low distortion at maximum signal levels may be reduced. Output transistors 40 and 44 are advantageously not included in any feedback loop such that they operate at their own transition frequency $f_T$. Transistors 40 and 44 are designed to operate at a very high frequency and have good transient settling response. The small signal output impedance of generator 10 is the parallel combination of the source impedances of transistors 40 and 44:

$$\frac{R_{s40}R_{s44}}{R_{s40}+R_{s44}} \quad (1)$$

where

-continued $$R_{s40} \sim \frac{1}{g_{m40}} \text{ and } R_{s44} \sim \frac{1}{g_{m44}}.$$

The output resistance $R_O$ is preferably designed to be on the order of tens of ohms and be constant to frequencies out very near to the $f_T$ of the devices.

Further, since the output of generator 10 is open loop, a very large capacitor, such as capacitor 50 in FIG. 1, can be connected to it without any stability problems. Capacitor 46, for example, may be an off-chip capacitor on the order of one microfarad, and can be used to lower the output impedance to approximately 1Ω at approximately 160 Khz and beyond. Since the integrated circuit upon which generator 10 is preferably employed may only have a capacitive load presented to the generator 10 itself, a large off-chip capacitor, such as capacitor 50, will act as a reservoir of charge to restore any glitch due to high frequency effects. Additionally, it should be recognized that if circuit 10 is used as part of an integrated circuit, and capacitor 46 is off-chip, a resistor (not shown) may be added in series with the circuit output to reduce the Q of an LC tank circuit resulting from capacitor 50 and the lead frame inductor.

Mid-rail voltage generator 10 is powered down by signal $\overline{\text{PWDN}}$ through n-channel transistor 52. To save power, the output of circuitry 10 goes to a high impedance state and p-channel transistors 54 and 56 clamp the output near the mid-supply voltage by supplying leakage current to keep capacitor 50 charged up.

It is important to recognize that the n-channel and p-channel devices can be interchanged, as known in the art, without change to the inventive concepts of the present invention as illustrated herein.

Although the present invention and its advantages have been described in detail, it should be understood that various changes, substitutions and alterations can be made herein without departing from the spirit and scope of the invention as defined by the appended claims.

What is claimed is:

1. A voltage generation circuit comprising:

a differential amplifier having a positive signal input, a negative signal input, and first and second outputs;

a voltage divider circuit comprising first and second transistors having source/drain paths coupled in series to establish a current path between a high voltage rail and a low voltage rail, said first and second transistors matched to provide a mid-supply voltage at a node along said current path, said node coupled to said positive input;

third and fourth transistors having source/drain paths coupled in series between said first and second outputs of said differential amplifier, sources of said third and fourth transistors to said negative input of said differential amplifier, a gate of said third transistor coupled to said first output of said differential amplifier and a gate of said fourth transistor coupled to said second output; and a pair of open-loop output transistors having source/drain paths coupled in series between said voltage rails, sources of said output transistors coupled together to provide a low impedance output of said voltage generation circuit, a first one of said output transistors having a gate coupled to said first output of said differential amplifier and matched to said third transistor, and a second one of said output transistors having a gate coupled to said second output and matched to said fourth transistor.

2. The voltage generation circuit of claim 1 wherein said first one of said output transistors has a channel width to length ratio of n times a channel width to length ratio of said third transistor and said second one of said output transistors has a channel width to length ratio of n times a channel width to length ratio of said fourth transistor, where n is a positive integer.

3. The voltage generation circuit of claim 2 wherein said first one of said output transistors comprises n parallel transistors each having a channel width to length ratio substantially equal to said channel width to length ratio of said third transistor and said second one of said output transistors comprises n parallel transistors each having a channel width to length ratio substantially equal to said channel width to length ratio of said fourth transistor.

4. The voltage generation circuit of claim 1 wherein said first and second transistors comprise first and second diode connected transistors having substantially equal channel width to length ratios, said node coupling a drain of said first transistor and a source of said second transistor.

5. The voltage generation circuit of claim 1 wherein said differential amplifier comprises:

a differential transistor pair comprising first and second differential transistor having sources coupled together and to a current source, a gate of said first differential transistors providing said positive input and a gate of said second differential transistor providing said negative input;

a first voltage amplifier transistor having a gate coupled to a drain of said first differential transistor, a source coupled to said low voltage rail and a drain providing said second output of said differential amplifier; and a second voltage amplifier transistor having a gate coupled to a drain of said second differential transistor, a source coupled to said low voltage rail and a drain;

a first mirroring transistor having a drain and a gate coupled to said drain of said second voltage amplifier transistor, and a source coupled to said high voltage supply rail; and a second mirroring transistor having a gate coupled to said gate of said first mirroring transistor, a source coupled to said high voltage supply rail and a drain providing said first output of said differential amplifier.

6. The voltage generation of claim 5 wherein said drain of said second voltage amplifier transistor is coupled to said first mirroring transistor through a cascode transistor, said cascode transistor having a source coupled to said drain of said second amplifier transistor, a drain coupled to said drain of said first mirroring transistor and a gate coupled to said node.

7. The voltage generation circuit of claim 1 wherein said differential amplifier includes a current supply input coupled to a current source comprising a pair of transistors having current paths coupled in series between said voltage rails.

8. The voltage generation of claim 7 wherein said current paths of said pair of transistors comprising said current supply are coupled by a resistor.

9. The voltage generation circuit of claim 7 wherein said current source is coupled to said current supply input through a current mirroring transistor.

10. The voltage generation circuitry of claim 7 and further comprising:

a power control device selectively coupling said pair of transistors included in said current source with a one of said voltage rails;

a first clamping transistor coupling said high voltage rail; and a second clamping transistor coupling said low voltage rail to said output of said circuitry, said first and second clamping transistors providing linkage current to said output.

11. Voltage generation circuitry comprising:

a differential amplifier having a positive signal input, a negative signal input, and first and second outputs;

a voltage divider circuit coupled between first and second voltage supplies and providing a preselected voltage to said positive input of said differential amplifier;

first and second transistors each having a current path and a control terminal, said current paths of said first and second transistors coupled at a node and further coupled in series between said first and second output of said amplifier, said control terminal of said first transistor coupled to said first output of said amplifier and said control terminal of said second transistor coupled to said second output, said node being coupled to said negative input of said differential amplifier; and third and fourth transistors having current paths coupled in series between said voltage supplies, a node coupling said current paths of said third and fourth transistors providing an output for said voltage generation circuitry, said third transistor having a control terminal coupled to said first output of said amplifier and matched as a current mirror with said first transistor, and said fourth transistor having a control terminal coupled to said second output of said amplifier and matched as a current mirror to said second transistor.

12. The voltage generation circuitry of claim 11 wherein said voltage divider circuit comprises first and second transistors having current paths coupled in series between said voltage supplies, said first and second transistors matched to provide said preselected voltage at a node coupling said current paths.

13. The voltage generation circuitry of claim 11 wherein said first, second, third and fourth transistors comprise field effect transistors.

14. The voltage generation circuit of claim 13 said third transistor has a channel width to length ratio of n times a channel width to length ratio of said first transistor and said fourth transistor has a channel width to length ratio of n times a channel width to length ratio of said second transistor.

15. The voltage generation circuitry of claim 11 wherein said second transistor and said fourth transistors are matched.

16. The voltage generation circuitry of claim 11 wherein said third transistor mirrors a current flowing in said first transistor with a current gain of substantially n, and said fourth transistor mirrors a current flowing in said second transistor with said substantial current gain of n, n being a positive number.

17. A voltage generator comprising:

a differential amplifier having a positive input coupled to a selected mid-rail voltage, a negative input and first and second outputs;

a pair of diode connected transistors establishing a current path between said outputs of said differential amplifier, sources of said pair of transistors coupled to said negative input, a gate and a drain of a first transistor of said pair driven by said first output, and a gate and drain of a second transistor of said pair driven by said second output; and a pair of output transistors establishing a second current path between said high voltage rail and said low voltage rail, a first one of said output transistors mirroring current flow in said first one of diode connected transistors and a second one of said output transistors mirroring current flow in said second one of said diode connected transistors, a current gain of each of said output transistors being substantially equal.

* * * * *